US008567337B2

(12) United States Patent
Chen

(10) Patent No.: US 8,567,337 B2
(45) Date of Patent: Oct. 29, 2013

(54) FLAG POLE DEVICE

(76) Inventor: Wu-Tsung Chen, Tainan (TW)

( * ) Notice: Subject to any disclaimer, the term of this patent is extended or adjusted under 35 U.S.C. 154(b) by 248 days.

(21) Appl. No.: 13/213,088

(22) Filed: Aug. 19, 2011

(65) Prior Publication Data

US 2013/0042800 A1 Feb. 21, 2013

(51) Int. Cl.
*G09F 17/00* (2006.01)

(52) U.S. Cl.
USPC ..... 116/174; 116/173

(58) Field of Classification Search
USPC ..... 116/173, 174, 175; 403/333, 354
IPC ..... G09F 17/00
See application file for complete search history.

(56) References Cited

U.S. PATENT DOCUMENTS

2006/0086308 A1* 4/2006 Chen ..... 116/174

* cited by examiner

*Primary Examiner* — Peter Macchiarolo
*Assistant Examiner* — Irving A Campbell
(74) *Attorney, Agent, or Firm* — Raymond Y. Chan; David and Raymond Patent Firm

(57) ABSTRACT

A flag pole device includes a pole, an upper rotary barrel and a lower rotary barrel rotatably mounted on the pole for securing a flag, and a connection rod connected between the upper rotary barrel and the lower rotary barrel. The upper rotary barrel and the lower rotary barrel each have a side column at the periphery, which has a through hole for receiving the connection rod. The connection rod has opposing flat top and bottom end portions disposed in the same plane and respectively inserted through a flat bottom hole portion of the through hole of the upper rotary barrel and a flat top hole portion of the through hole of the lower rotary barrel and positioned in a respective crossed hole portion and stopped at a respective step in the side column of the upper rotary barrel and the side column of the lower rotary barrel, assuring synchronous rotation of the upper rotary barrel and the lower rotary barrel and avoiding tangling of the flag on the pole.

5 Claims, 9 Drawing Sheets

A-A'

B-B'

C-C'

D-D'

FLAG POLE DEVICE

BACKGROUND OF THE PRESENT INVENTION

1. Field of Invention

The present invention relates to flag pole devices and more particularly, to such a flag pole device, which assures synchronous rotation of the flag-mounting upper and lower rotary barrels relative to the pole, avoiding tangling of the flag on the pole.

2. Description of Related Arts

A conventional flag pole generally comprises two bearing portions for the fastening of the inner upper and lower corners of a flag. During application, the flag may be tangled on the pole due to the effect of wind force. To avoid the flag from tangling on the pole, a flag pole device is disclosed using a connection rod to connect two or three rotary members that are pivotally mounted on the pole for securing the flag. When the flag is flying upon the wind, the rotary members can be synchronously rotated relative to the pole, avoiding the flag from tangling on the pole. This improved design is seen in Taiwan Patent M263591. However, as the connection rod is a round rod coupled between the rotary members. During application, the connection between the connection rod and each rotary member may be loosened. When this condition occurred, the rotary members may be not rotated synchronously relative to the pole. If the rotary members cannot be rotated synchronously relative to the pole, the flag may be tangled on the pole when flying in the wind.

SUMMARY OF THE PRESENT INVENTION

The present invention has been accomplished under the circumstances in view. It is therefore the main object of the present invention to provide a flag pole device, which assures a high level of structural stability and avoids tangling of the flag on the pole.

To achieve this and other objects of the present invention, a flag pole device comprises a pole, an upper rotary barrel rotatably supported on a top end of the pole, a lower rotary barrel rotatably mounted around the pole, and a connection rod connected between the upper rotary barrel and the lower rotary barrel. The upper rotary barrel and the lower rotary barrel each comprise a lug for the fastening of a flag, and a side column formed integral with the periphery thereof.

The side column of each of the upper rotary barrel and lower rotary barrel comprises a through hole cutting through opposing top and bottom sides thereof. The through hole of the side column of the upper rotary barrel comprises a flat bottom hole portion, a crossed hole portion disposed at the top side of the flat bottom hole portion, and a step defined between the flat bottom hole portion and the crossed hole portion. The through hole of the side column of the lower rotary barrel comprises a flat top hole portion, a crossed hole portion disposed at the bottom side of the flat top hole portion, and a step defined between the flat top hole portion and the crossed hole portion. The connection rod comprises opposing flat top end portion and flat bottom end portion disposed in the same plane. The flat top end portion of the connection rod is inserted upwardly through the flat bottom hole portion of the through hole of the upper rotary barrel and positioned in the crossed hole portion of the side column of the upper rotary barrel and stopped at the step of the through hole of the side column of the upper rotary barrel. The flat bottom end portion of the connection rod is inserted downwardly through the flat top hole portion of the through hole of the side column of the lower rotary barrel and positioned in the crossed hole portion of the side column of the lower rotary barrel and stopped at the step of the through hole of the side column of the lower rotary barrel.

Further, an upper stop member and a lower stop member are respectively plugged into the top end of the through hole of the side column of the upper rotary barrel and the bottom end of the through hole of the side column of the lower rotary barrel to stop the connection rod in the side column of the upper rotary barrel and the side column of the lower rotary barrel.

Further, an anchoring member is detachably fastened to the bottom end of the pole for mounting.

Further, the anchoring member comprises a round tube, an angle bar affixed to a bottom end of the round tube and terminating in a pointed bottom end piece for fastening to the soil.

Further, the angle bar of the anchoring member comprises a hitting lug at one lateral side thereof.

DETAILED DESCRIPTION OF THE PREFERRED EMBODIMENT

Figure 1:
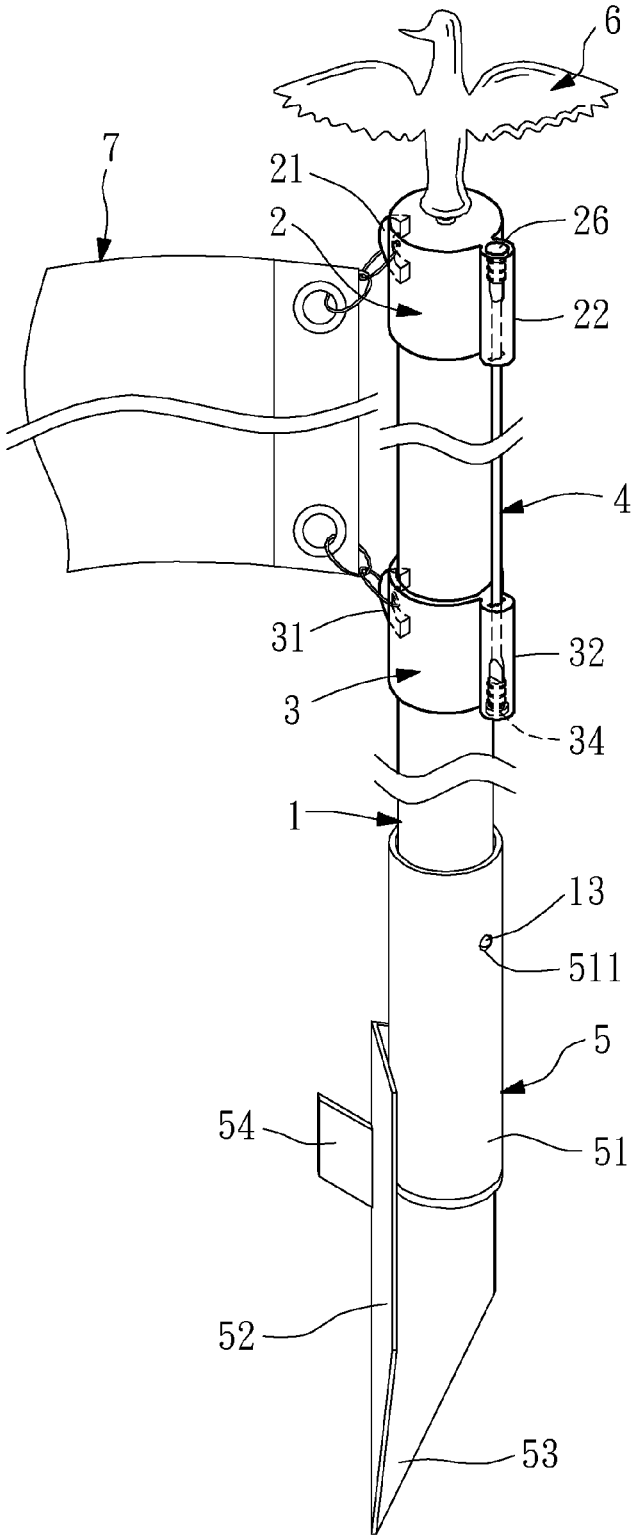
FIG. 1 is an elevational view of a flag pole device in accordance with the present invention.
Figure 2:
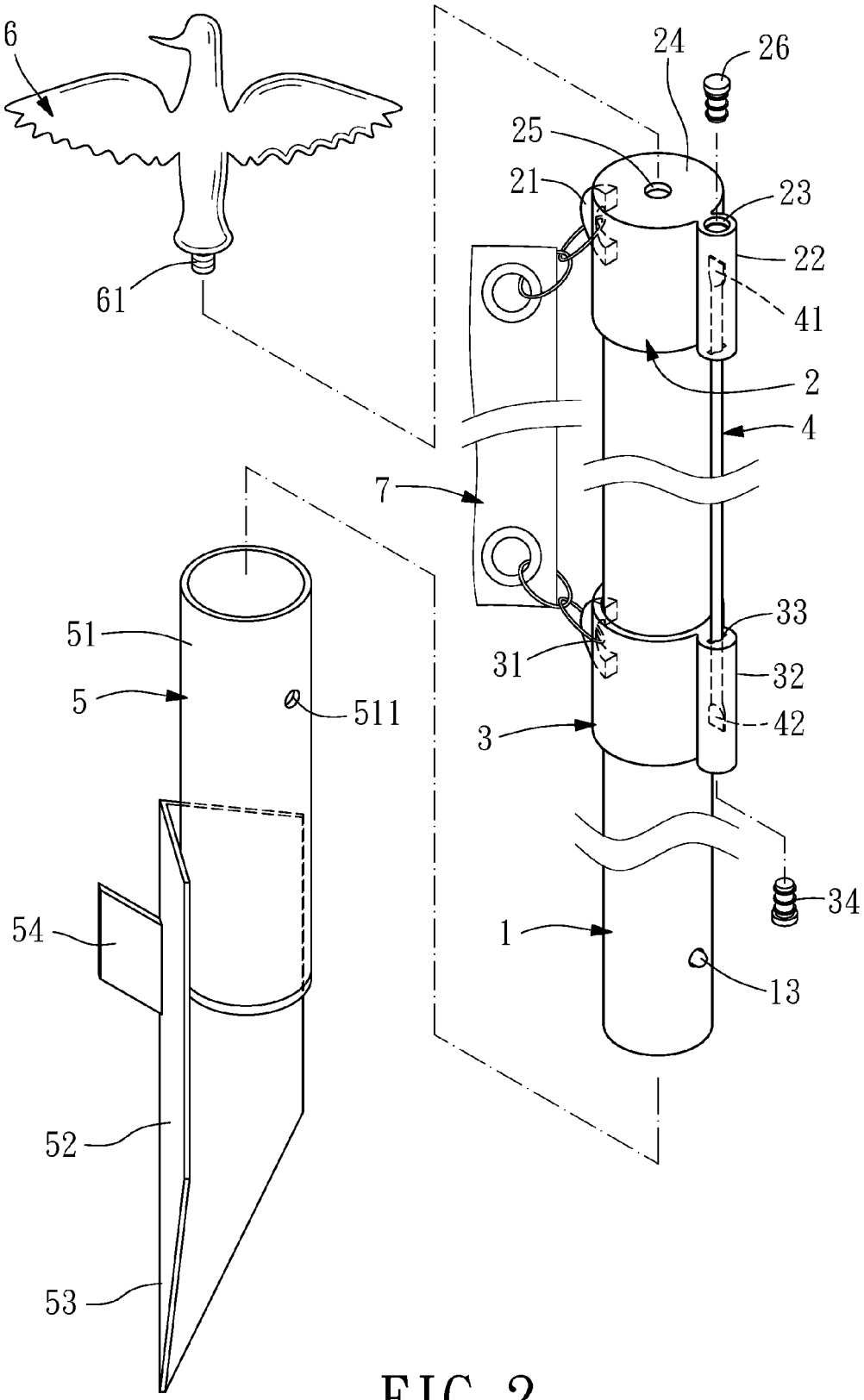
FIG. 2 is an exploded view of the flag pole device in accordance with the present invention.

Referring to FIGS. 1 and 2, a flag pole device in accordance with the present invention is shown comprising a pole 1, an upper rotary barrel 2, a lower rotary barrel 3, a connection rod 4 and an anchoring member 5.

Figure 3:
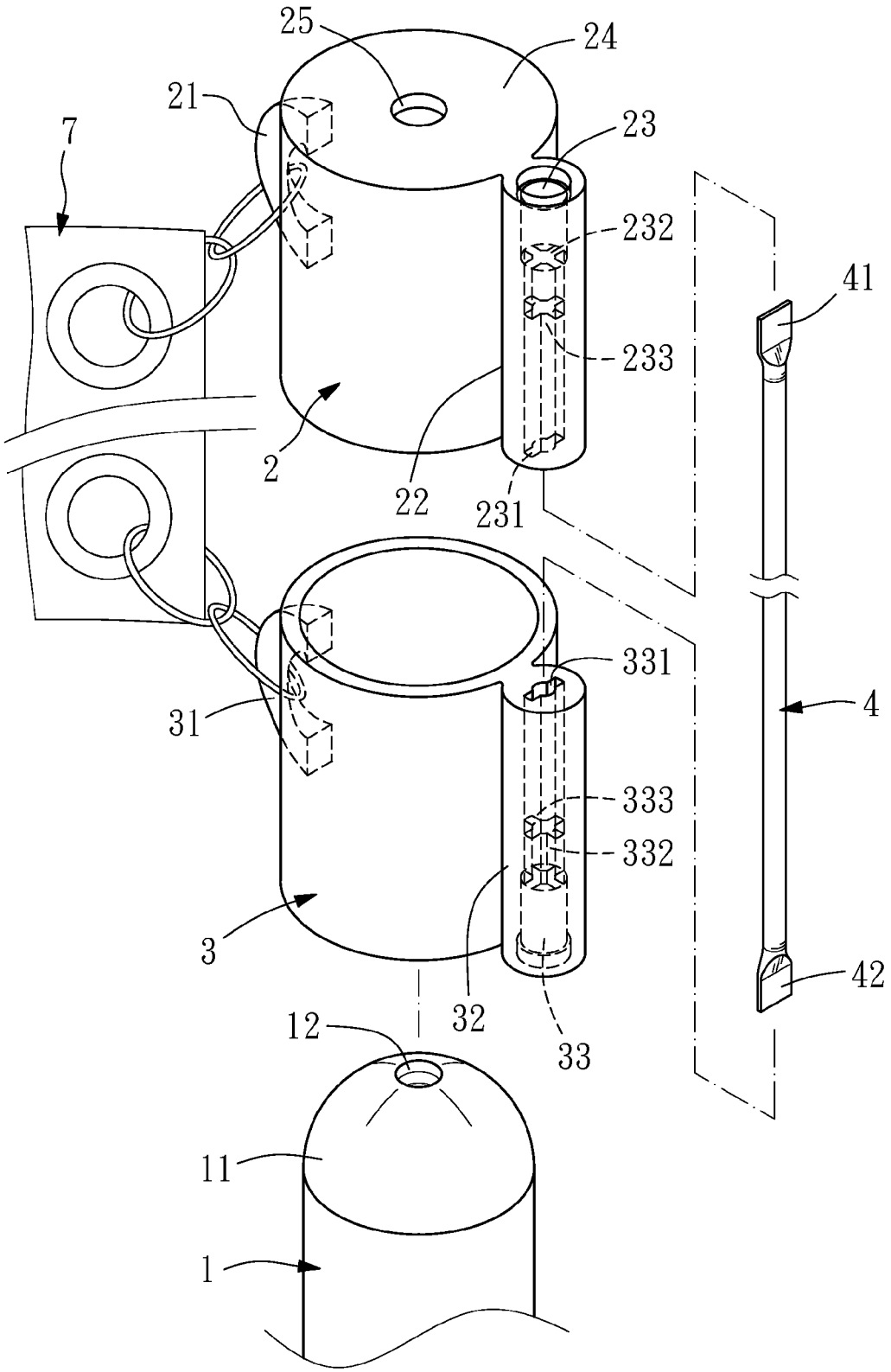
FIG. 3 is an exploded view of the upper part of the flag pole device in accordance with the present invention.
Figure 4:
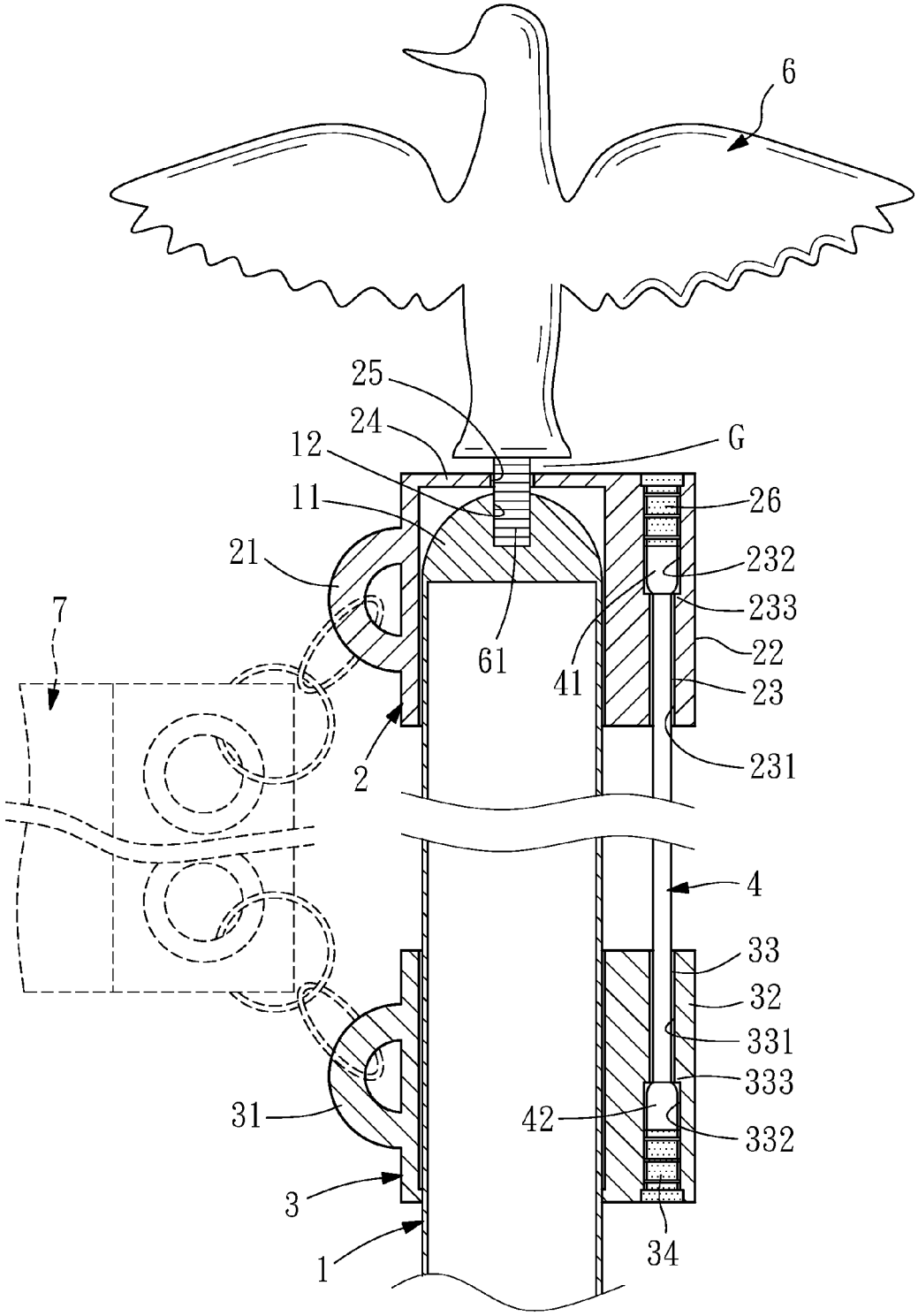
FIG. 4 is a sectional assembly view of the upper part of the flag pole device in accordance with the present invention.

The pole 1 has a convex top edge 11 (see FIG. 3), and a screw hole 12 located on the center of the convex top edge 11 for the mounting of an ornament 6 (see FIG. 4).

The upper rotary barrel 2 comprises a top wall 24 supported on the convex top edge 11 of the pole 1 and rotatable with the upper rotary barrel 2 relative to the pole 1 (see FIG. 4), a through hole 25 cut through the top wall 24 and in axial alignment with the screw hole 12 for the passing of the bottom screw rod 61 of the ornament 6 for enabling the bottom screw rod 61 to be threaded into the screw hole 12, a lug 21 protruded from the peripheral surface thereof at one side near the top wall 24 for the hanging of the inner upper corner of a flag 7 (see FIG. 3), and a side column 22 formed integral with the peripheral surface and longitudinally disposed opposite to the lug 21. After the bottom screw rod 61 of the ornament 6 is inserted through the through hole 25 and threaded into the screw hole 12, a gap G is left between the ornament 6 and the top wall 24, allowing free rotation of the upper rotary barrel 2 relative to the pole 1. The side column 22 comprises a through hole 23 cutting through opposing top and bottom sides thereof. The through hole 23 comprises a flat bottom hole portion 231, a crossed hole portion 232 disposed at the top side of the flat bottom hole portion 231, and a step 233 defined between the flat bottom hole portion 231 and the crossed hole portion 232.

The lower rotary barrel 3 is sleeved onto the pole 1, comprising a lug 31 protruded from the peripheral surface thereof at one side for the hanging of the inner lower corner of the flag 7 (see FIG. 3), and a side column 32 formed integral with the peripheral surface and longitudinally disposed opposite to the lug 31. The side column 32 comprises a through hole 33 cutting through opposing top and bottom sides thereof. The through hole 33 comprises a flat top hole portion 331, a crossed hole portion 332 disposed at the bottom side of the flat top hole portion 331, and a step 333 defined between the flat top hole portion 331 and the crossed hole portion 332.

Figure 5:
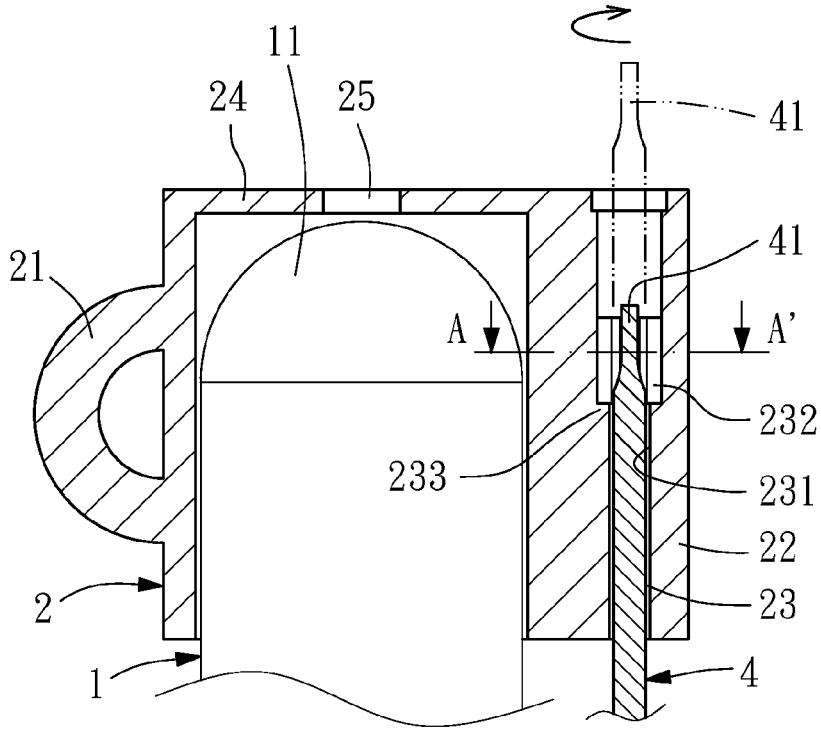
FIG. 5 is a schematic sectional view of the present invention, illustrating the mounting operation between the upper rotary barrel and the connection rod.
Figure 6:
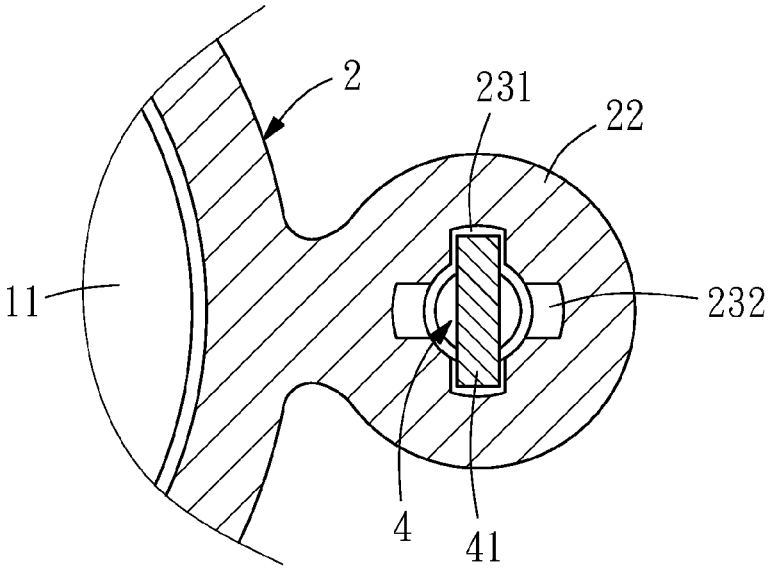
FIG. 6 is a sectional view taken along line A-A' of FIG. 5.
Figure 7:
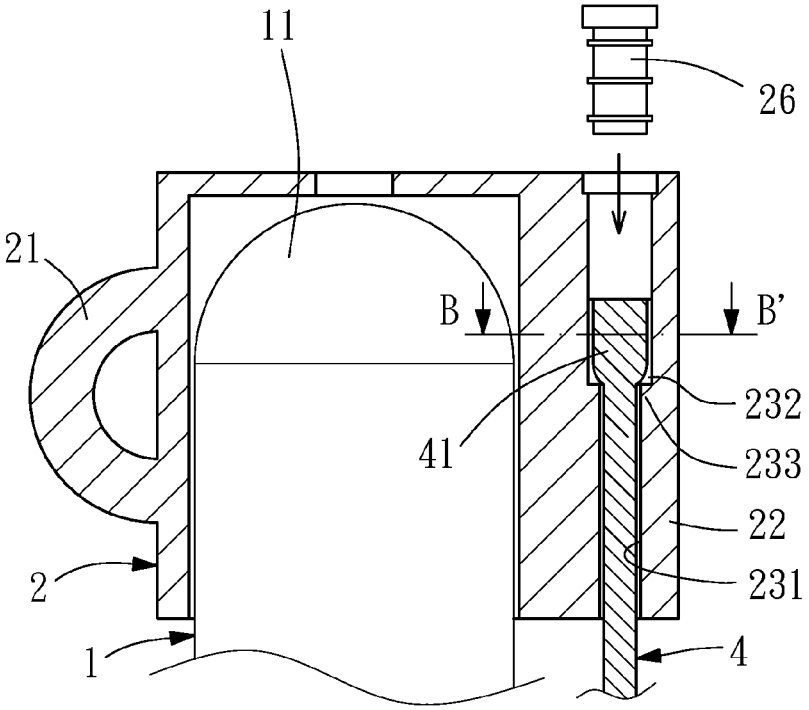
FIG. 7 corresponds to FIG. 5, illustrating the mounting direction of the upper stop member relative to the upper rotary barrel.
Figure 8:
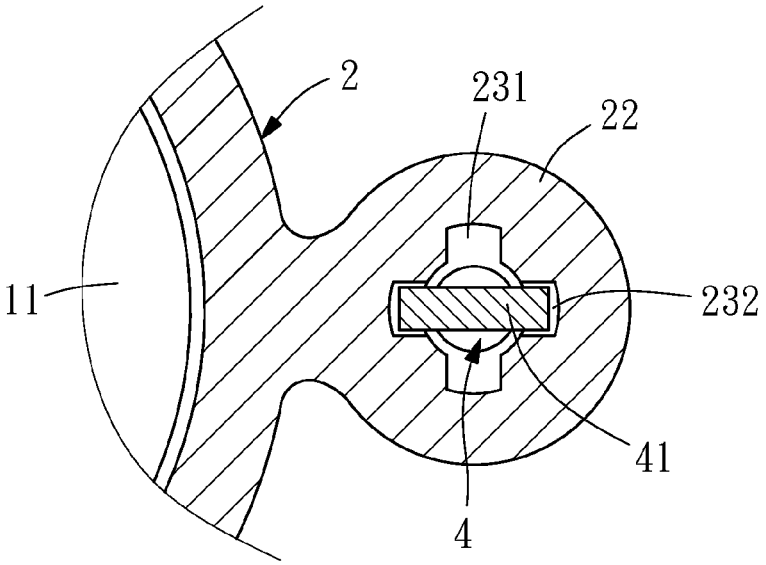
FIG. 8 is a sectional view taken along line B-B' of FIG. 7.
Figure 9:
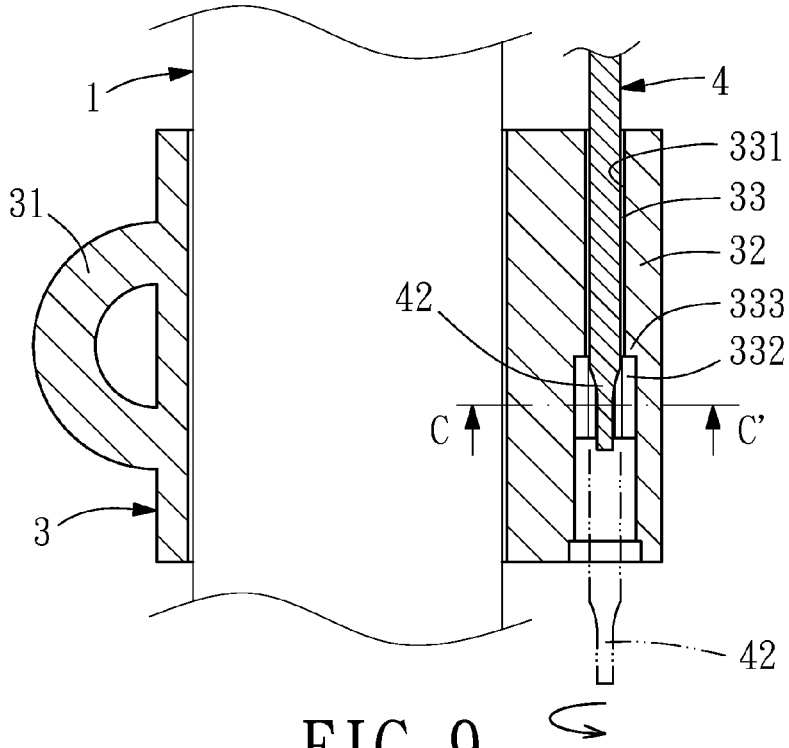
FIG. 9 is a schematic sectional view of the present invention, illustrating the mounting operation between the lower rotary barrel and the connection rod.
Figure 10:
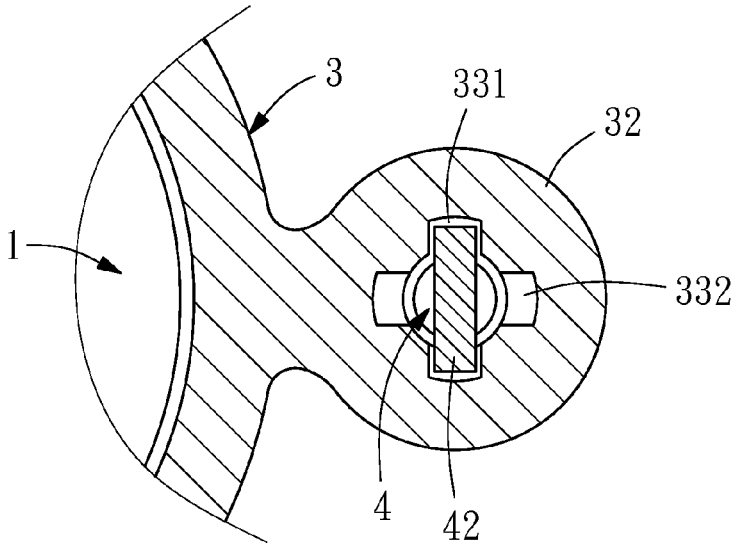
FIG. 10 is a sectional view taken along line C-C' of FIG. 9.
Figure 11:
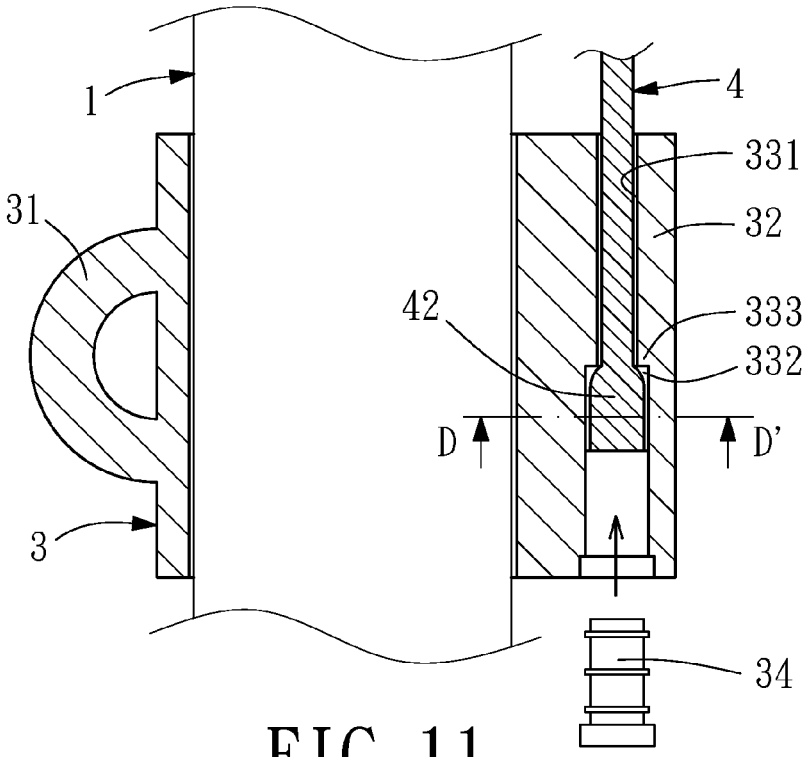
FIG. 11 corresponds to FIG. 9, illustrating the mounting direction of the lower stop member relative to the lower rotary barrel.
Figure 12:
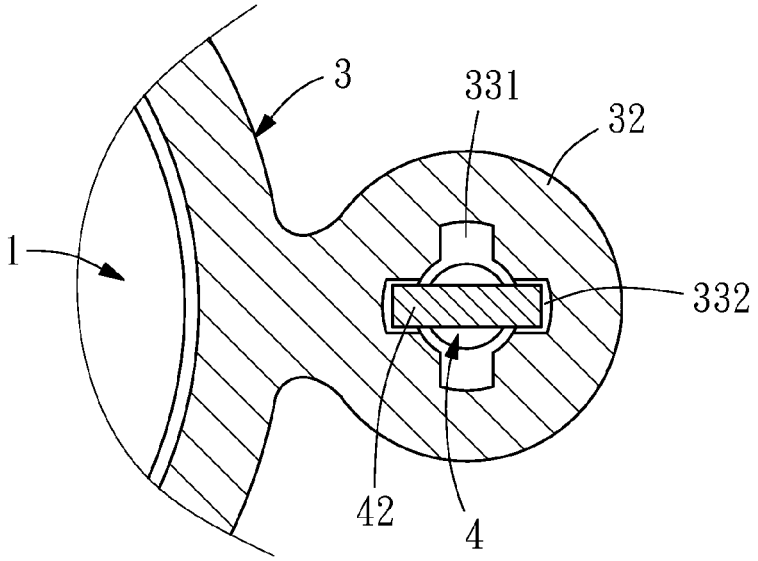
FIG. 12 is a sectional view taken along line D-D' of FIG. 11.

The connection rod 4 is coupled between the upper rotary barrel 2 and the lower rotary barrel 3, comprising opposing flat top end portion 41 and flat bottom end portion 42 disposed in the same plane (see FIG. 3). The flat top end portion 41 is inserted upwardly through the flat bottom hole portion 231 of the through hole 23 of the upper rotary barrel 2 (see FIGS. 5 and 6) and then rotated through a predetermined angle and then lowered and positioned in the crossed hole portion 232 and stopped at the step 233 of the through hole 23 of the upper rotary barrel 2 (see FIGS. 7 and 8). The flat bottom end portion 42 is inserted downwardly through the flat top hole portion 331 of the through hole 33 of the lower rotary barrel 3 (see FIGS. 9 and 10) and then rotated through a predetermined angle and then lifted and positioned in the crossed hole portion 332 and stopped at the step 333 of the through hole 33 of the lower rotary barrel 3 (see FIGS. 11 and 12). Further, an upper stop member 26 is plugged into the top end of the through hole 23 of the side column 22 of the upper rotary barrel 2 to stop the connection rod 4 in the side column 22 of the upper rotary barrel 2 (see FIGS. 4 and 7); a lower stop member 34 is plugged into the bottom end of the through hole 33 of the side column 32 of the lower rotary barrel 3 to stop the connection rod 4 in the side column 32 of the lower rotary barrel 3 (see FIGS. 4 and 11).

Figure 13:
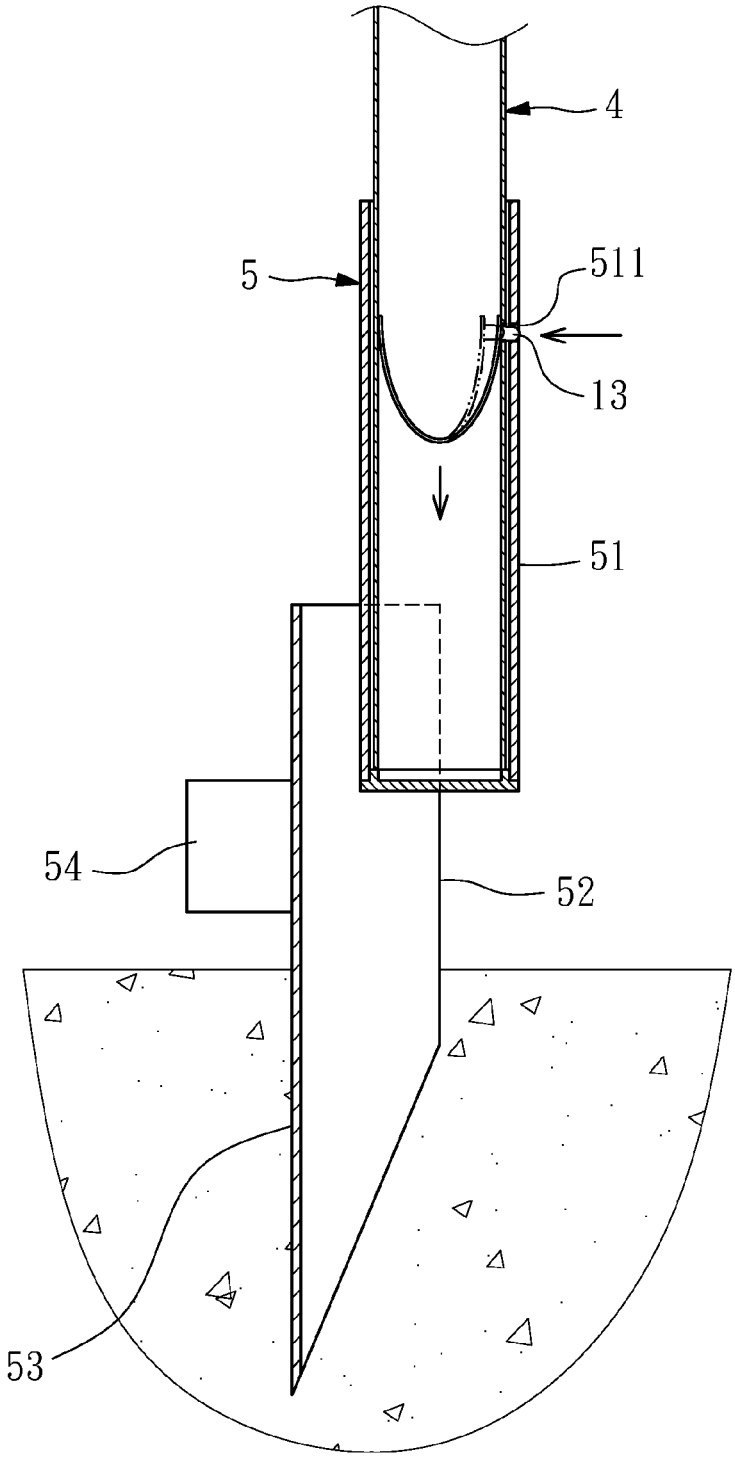
FIG. 13 is a schematic drawing of the present invention, illustrating the anchoring member fastened to the bottom end of the pole and driven into the soil.

The anchoring member 5 comprises a round tube 51, and an angle bar 52 fixedly fastened to the bottom end of the round tube 51 (see FIG. 1). The angle bar 52 has a pointed bottom end piece 53 for fastening to the ground. The round tube 51 has a pin hole 511 transversely cut through the tube wall thereof at a selected location (see FIG. 2). Further, the pole 1 comprises a spring-supported retainer rod 13 disposed near the bottom end thereof, which, when the bottom end of the pole 1 is inserted into the round tube 51 is engaged into the pin hole 511 of the round tube 51 (see FIG. 13). Pressing the spring-supported retainer rod 13 allows separation of the pole 1 from the round tube 51. Further, the angle bar 52 has a hitting lug 54 at one lateral side thereof for the grasping of the hitting to apply force to the anchoring member 5.

During application, the flat top end portion 41 and flat bottom end portion 42 of the connection rod 4 are respectively positioned in the through hole 23 of the side column 22 of the upper rotary barrel 2 and the through hole 33 of the side column 32 of the lower rotary barrel 3 and respectively stopped at the respective steps 233;333 and kept in the same plane. Thus, the upper rotary barrel 2 and the lower rotary barrel 3 are synchronously rotatable relative to the pole 1. When the upper and lower parts of the flag 7 are forced by different wind forces to oscillate in different directions, the upper rotary barrel 2 and the lower rotary barrel 3 are synchronously rotated relative to the pole 1, avoiding tangling of the flag 7 on the pole 1. Further, the upper stop member 26 and the lower stop member 34 are respectively fastened to the top end of the through hole 23 of the side column 22 of the upper rotary barrel 2 and the bottom end of the through hole 33 of the side column 32 of the lower rotary barrel 3, avoiding separation of the connection rod 4 from the upper rotary barrel 2 or the lower rotary barrel 3, assuring a high level of structural stability.

Further, the anchoring member 5 is conveniently detachably fastened to the pole 1. By means of the pointed bottom end piece 53 of the angle bar 52, the anchoring member 5 can easily be driven into the soil.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A flag pole device, comprising a pole, an upper rotary barrel rotatably supported on a top end of said pole, a lower rotary barrel rotatably mounted around said pole, and a connection rod connected between said upper rotary barrel and said lower rotary barrel, said upper rotary barrel and said lower rotary barrel each comprising a lug for the fastening of a flag, wherein:

said upper rotary barrel comprises a side column formed integral with the periphery thereof, the side column of said upper rotary barrel comprising a through hole cutting through opposing top and bottom sides thereof, the through hole of the side column of said upper rotary barrel comprising a flat bottom hole portion, a crossed hole portion disposed at a top side of said flat bottom hole portion, and a step defined between said flat bottom hole portion and the crossed hole portion of the side column of said upper rotary barrel;

said lower rotary barrel comprises a side column formed integral with the periphery thereof, the side column of said lower rotary barrel comprising a through hole cutting through opposing top and bottom sides thereof, the through hole of the side column of said lower rotary barrel comprising a flat top hole portion, a crossed hole portion disposed at a bottom side of said flat top hole portion, and a step defined between said flat top hole portion and the crossed hole portion of the side column of said lower rotary barrel;

said connection rod comprises opposing flat top end portion and flat bottom end portion disposed in the same plane, said flat top end portion being inserted upwardly through the flat bottom hole portion of the through hole of said upper rotary barrel and positioned in the crossed hole portion of the side column of said upper rotary barrel and stopped at the step of the through hole of the side column of the upper rotary barrel, said flat bottom end portion being inserted downwardly through the flat top hole portion of the through hole of the side column of said lower rotary barrel and positioned in the crossed hole portion of the side column of said lower rotary barrel and stopped at the step of the through hole of the side column of said lower rotary barrel.

2. The flag pole device as claimed in claim 1, further comprising an upper stop member plugged into a top end of the through hole of the side column of said upper rotary barrel to stop said connection rod in the side column of said upper rotary barrel, and a lower stop member plugged into a bottom end of the through hole of the side column of said lower rotary barrel to stop said connection rod in the side column of said lower rotary barrel.

3. The flag pole device as claimed in claim 2, further comprising an anchoring member fastened to a bottom end of said pole, said anchoring member comprising a pointed bottom end piece for mounting.

4. The flag pole device as claimed in claim 3, wherein said anchoring member comprises a round tube, an angle bar affixed to a bottom end of said round tube and terminating in said pointed bottom end piece.

5. The flag pole device as claimed in claim 4, wherein said angle bar comprises a hitting lug at one lateral side thereof.

* * * * *